United States Patent [19]

Jerome

[11] 4,163,547

[45] Aug. 7, 1979

[54] CLAMPING APPARATUS FOR ASSEMBLING PICTURE FRAMES

[76] Inventor: Henry M. Jerome, 1689 Sherway Dr., Mississauga, Ontario, Canada, L4X 1C9

[21] Appl. No.: 879,230

[22] Filed: Feb. 21, 1978

[51] Int. Cl.[2] ..... B25B 1/20

[52] U.S. Cl. ..... 269/42; 269/109; 269/115; 269/130

[58] Field of Search ..... 269/41–42, 269/108–109, 111, 115, 130–132

[56] References Cited

U.S. PATENT DOCUMENTS

| | | | |
|---|---|---|---|
| 831,486 | 9/1906 | Taft | 269/115 |
| 1,645,609 | 10/1927 | Maxwell | 269/130 |
| 3,224,754 | 12/1965 | Graham | 269/130 |
| 3,590,458 | 7/1971 | Day | 269/41 X |
| 3,610,612 | 10/1971 | Day | 269/109 |
| 4,032,130 | 6/1977 | Huntley et al. | 269/41 X |
| 4,047,710 | 9/1977 | Wilson | 269/42 |

FOREIGN PATENT DOCUMENTS

| | | | |
|---|---|---|---|
| 798851 | 7/1958 | United Kingdom | 269/132 |

*Primary Examiner*—Robert C. Watson

*Attorney, Agent, or Firm*—Fetherstonhaugh & Co.

[57] ABSTRACT

A clamping apparatus for use in assembling a picture frame as described herein comprises an anchoring corner block and a plurality of secondary corner blocks and a flexible cable. The cable has one end secured in the anchoring corner block and extends through the secondary corner blocks so that its other end may be releasably secured to the anchoring corner block. When the corner blocks are located in a position supporting an assembled set of picture frame members arranged in the required configuration a clamping load may be applied thereto by the corner blocks by applying a tensile load to the flexible cable. The various corner blocks are adapted to support the flexible cable in one or other of several predetermined planes selected to provide support for the particular frame moulding configuration which has to be clamped.

11 Claims, 17 Drawing Figures

CLAMPING APPARATUS FOR ASSEMBLING PICTURE FRAMES

FIELD OF INVENTION

This invention relates to a clamping apparatus for use in assembling a picture frame.

PRIOR ART

Numerous attempts have been made to provide apparatus for retaining picture frame members in the required frame configuration to permit the frame members to be secured with respect to one another.

One example of a clamping apparatus for use in assembling a picture frame is disclosed in U.S. Pat. No. 4,047,710, dated Sept. 13, 1977 and issued to John Wilson. This apparatus requires a base which is adapted to support a number of corner blocks so that the corner blocks may be retained in a fixed relationship with respect to one another. A tensioning belt extends around the corner blocks and is connected to an independent tensioning assembly which is secured to the base and which is operable to apply a load to the belt. This apparatus is complex and costly and it requires that the frame remain in the apparatus on the base until it is permanently secured in the required configuration.

A further device which includes a base and corner blocks is illustrated in U.S. Pat. No. 4,032,130, dated June 28, 1977 and issued to James R. Huntley et al. Once again, a base member is required and the corner blocks are retained with respect to the base. This apparatus is costly and requires complex manipulation in order to clamp the picture frame in the required configuration.

U.S. Pat. No. 3,590,458, dated July 6, 1971 and issued to Clifford H. Day discloses a four-corner picture frame assembly which includes four arms which are pivotally mounted on a base and conventional corner clamps slidably mounted on each arm. This mechanism is costly and, again, requires a support base structure.

In the assembly of a picture frame, it is desirable to use an adhesive for connecting the abutting ends of the frame. When an adhesive is used to secure the frame in the required configuration, it is necessary to retain the frame in the required configuration for a sufficient time to enable the adhesive to set. Thus, it is important to minimize the cost of the clamping apparatus so that a framer may have several clamping devices available so that he may have several frames under construction at the same time. Furthermore, it would be helpful to avoid the use of a base so that the frames may be stored during setting of the adhesive at a point remote from the work bench on which the frame is initially assembled.

In addition, it is important to minimize the amount of time required to arrange the frame members in the required configuration and to lock them in the required configuration and to release the clamping mechanism after the frame has been secured in the required configuration.

It is an object of the present invention to provide a clamping apparatus for use in assembling a picture frame which is inexpensive to manufacture and which is simple to operate.

I have found that a flexible cable extended around a picture frame and secured at opposite ends to an anchoring corner block, with one end being releasably secured to the anchoring corner block, may serve to retain picture frame members in the required frame configuration.

I have also found that a clamping apparatus for use in assembling a picture frame may consist of an anchoring corner block, a plurality of secondary corner blocks and a flexible cable, the flexible cable having one end secured to the anchoring corner block and extending around the secondary corner blocks arranged in the required frame configuration and having the other end releasably secured in the anchoring corner block.

SUMMARY

According to one aspect of the present invention, there is provided in a clamping apparatus for use in assembling a picture frame comprising an anchoring corner block having frame support surfaces adopted to engage adjacent ends of one pair of picture frame members of an assembled set of picture frame members arranged in the required frame configuration, a flexible cable, first securing means on said anchoring corner block for securing one end of said flexible cable with respect to said anchoring corner block and second securing means on said anchoring corner block for releasably securing a second end of said flexible cable, said flexible cable having a sufficient length to extend from said first securing means about the external periphery of the assembled set of picture frame members to said second securing means whereby the flexible cable may be drawn tightly about the frame to be assembled and thereafter the second end of the flexible cable may be secured with respect to said anchoring corner block.

According to a further aspect of the present invention, there is provided a clamping apparatus for use in assembling a picture frame comprising, an anchoring corner block having frame support surfaces adapted to engage adjacent ends of one pair of picture frame members of an assembled set of picture frame members arranged in the required frame configuration, a flexible cable, first securing means on said anchoring corner block for securing one end of said flexible cable with respect to said anchoring corner block and second securing means on said anchoring corner block for releasably securing a second end of said flexible cable, said flexible cable having a sufficient length to extend from said first securing means about the external periphery of the assembled set of picture frame members to said second securing means, a plurality of secondary corner blocks, each having a frame support surface adapted to engage and support a pair of adjacent ends of the assembled set of picture frame members, cable guide means on each secondary corner block adapted to receive and guide said flexible cable therealong such that said flexible cable may be drawn tightly about said assembled set with the tensile load which is applied to the cable in use substantially uniformly distributed along the length of the flexible cable from said first securing means to said second securing means on said anchoring corner block.

PREFERRED EMBODIMENT

The invention will be more clearly understood after reference to the following detailed specification read in conjunction with the drawings, wherein FIG. 1 is a pictorial view of a clamping apparatus constructed in accordance with an embodiment of the present invention securing four picture frame members in the required frame configuration;

FIG. 2 is a plan view of an anchoring corner block;

FIG. 3 is a side view of the anchoring corner block of FIG. 2;

FIG. 5 is an end view of one arm of the anchoring corner block of FIG. 2;

Figure 1:
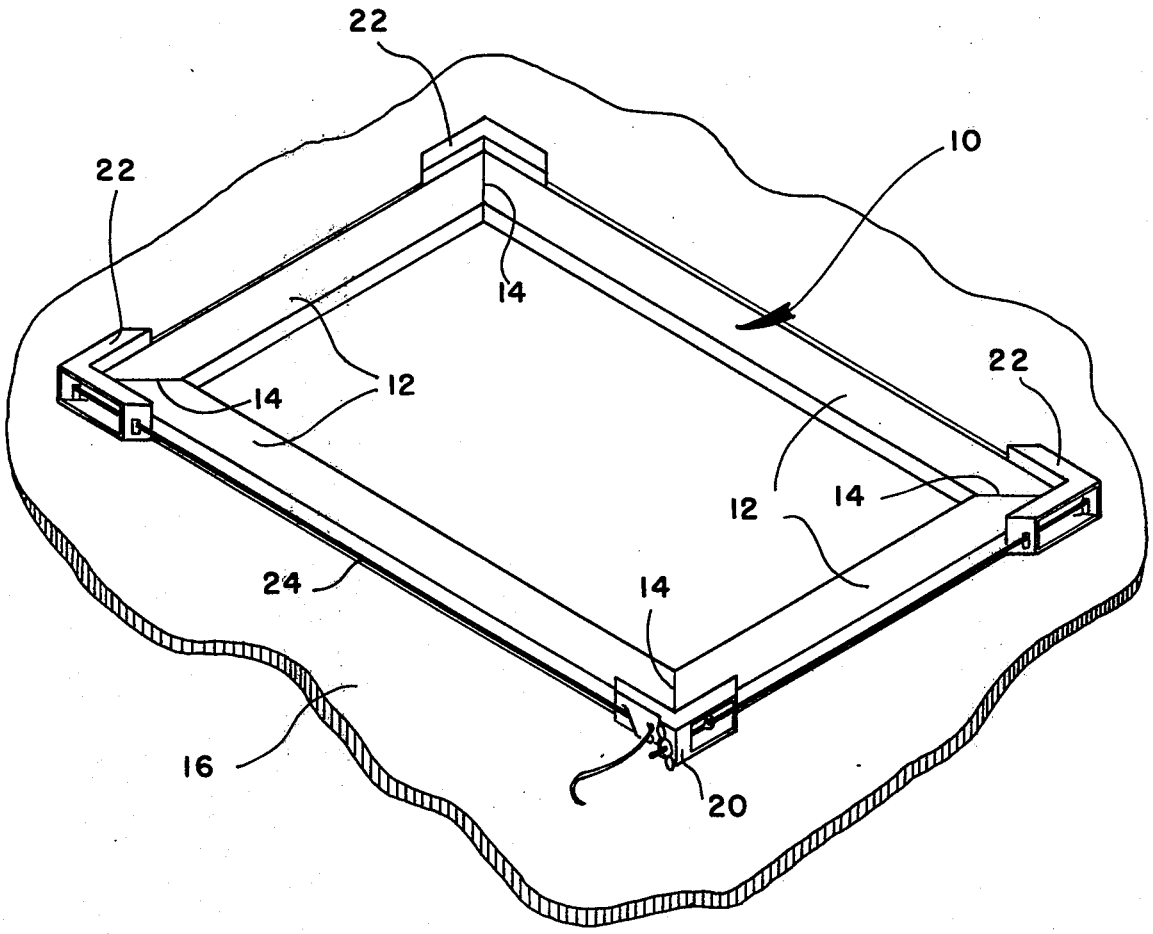
Figure 4:
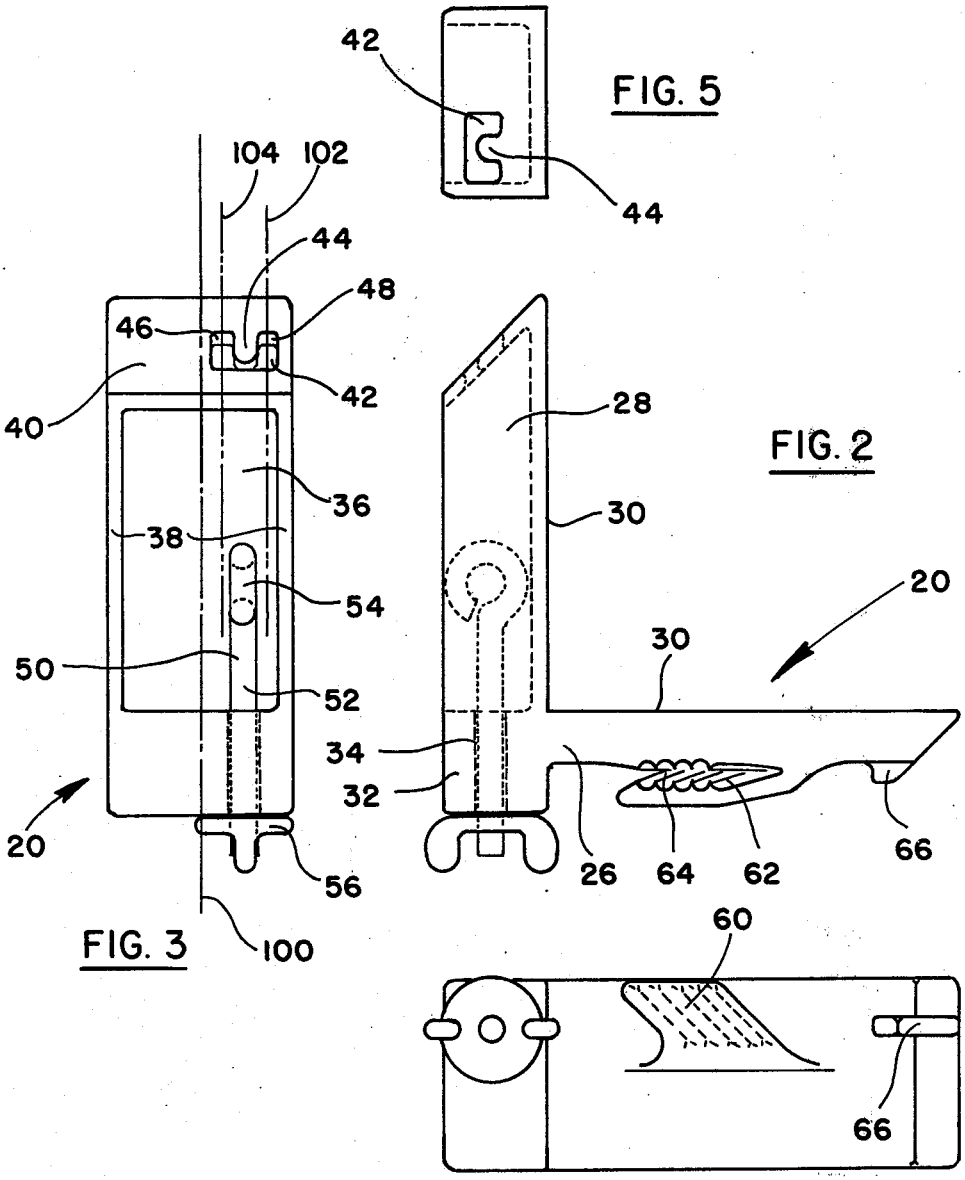
FIG. 4 is a front view of the anchoring corner block of FIG. 2.

With reference to FIG. 1 of the drawings, the reference numeral 10 refers generally to an assembled picture frame which consists of four picture frame mouldings 12 which are to be supported in a rectangular configuration so that abutting end faces 14 may be secured with respect to one another.

A clamping apparatus according to a preferred embodiment of the present invention consists of an anchoring corner block 20, a plurality of secondary corner blocks 22 and a flexible cable 24. The corner blocks 20 and 22 may be made from any material such as wood, metal or plastic which is sufficiently rigid to retain its shape when loaded. The flexible cord may be made from any material which has the required strength and flexibility. Nylon rope is one example of a suitable material.

While the clamping operation is preferably carried out on a planar support base 16, it will be understood that the base 16 may be the top of a work bench or the like and is not integrally connected to the clamping apparatus.

With reference to FIGS. 2 to 5 of the drawings, it will be seen that an anchor block 20 constructed in accordance with one embodiment of the present invention has arms 26 and 28 which extend at right angles to one another. Each of the arms 26 and 28 has a frame support surface 30 adapted to engage adjacent ends of one pair of picture frame members, as illustrated in FIG. 1 of the drawings, to locate the ends of the frame members in the required abutting relationship. The arm 28 has a shoulder block 32 at one end thereof formed with a passage 34 opening therethrough. Inwardly from the shoulder block 32, the arm 28 has a U-shaped configuration and includes a front wall 36 and a pair of oppositely disposed side walls 38. An end wall 40 is located at the free end of the arm 28 and is formed with a guide passage 42 opening therethrough. A finger 44 projects into the passage 42 in a direction away from the support face 30 to divide the passage into two slipways 46 and 48 arranged one above the other. The finger 44 does not extend across the full width of the passage 42 with the result that it is possible to move the flexible cable from one slipway to the other without removing it from the passage 42. The distance between the outer end of the finger 44 and the opposite wall of the passage 42 is slightly less than the diameter of the flexible cable 24 so that the cable must be deliberately located in one or other slipway.

It will be noted that the passage 34 which is formed in the shoulder 32 is substantially aligned with the passage 42 formed in the end wall 40. An anchor pin is provided in the form of an eye-bolt 50 having a shank 52 and an eye-ring 54. The shank 52 extends through the passage 34 and a wing-nut 56 is mounted on the threaded end thereof. In use, one end of the flexible cable 24 is secured to the eye-ring 54 and a tensioning load may be applied to the cable by driving the wing-nut 56 along the threaded shank 52.

The anchoring corner block 20 has a second securing mechanism located on the outer face of the arm 26. The second securing mechanism is in the form of a jam cleat which includes a flange 60 which projects outwardly from the outer face of the arm 26 and a plurality of clamping ridges 62 formed in the V-shaped channel 64 located between the flange 60 and the inner face of the arm 26. The V-shaped passage 64 opens upwardly at one side of the anchor block and the ridges 62 are inclined downwardly and outwardly towards the free end of the arm 26 so as to resist withdrawal of the flexible cable in a direction towards the free end of the arm 26. A finger 66 projects outwardly from the inner face of the arm 26 adjacent the free end thereof and serves to deflect the anchoring cable into one or other of two clamping planes disposed above and below the finger 66 as required in use.

Figure 6:
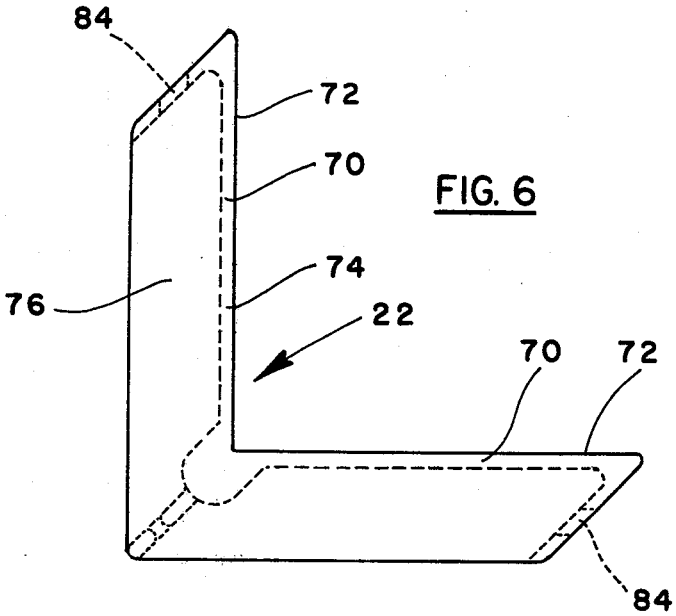
FIG. 6 is a plan view of a secondary corner block.
Figure 8:
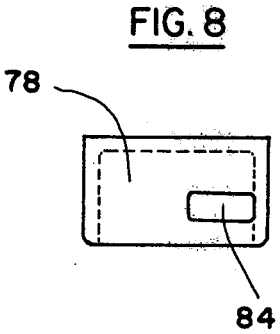
FIG. 8 is an end view of one arm of the corner block of FIG. 6.
Figure 7:
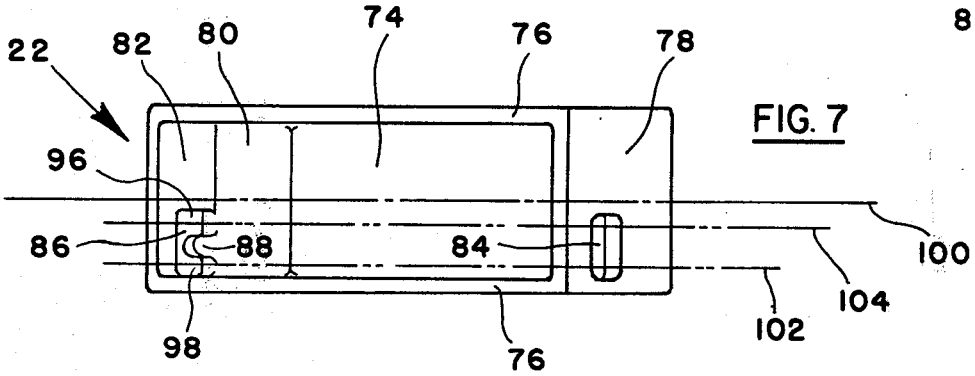
FIG. 7 is a front view of the corner block of FIG. 6.

A secondary corner block constructed in accordance with an embodiment of the present invention is illustrated in FIGS. 6, 7 and 8 of the drawings. The secondary corner block 22 consists of a pair of arms 70, each of which has an inwardly directed frame support surface 72. Each arm 70 consists of an inner wall 74 and a pair of side walls 76 arranged in a U-shaped configuration. An end wall 78 extends across the free end of each arm 70. A corner post 80 is located at the inner ends of the inner walls 74 and projects outwardly therefrom. End wall 82 projects outwardly from the corner post 80. Passages 84 are formed in each of the end walls 78 and a passage 86 is formed in the end wall 82. A finger 88 projects outwardly from the corner post 80 to divide the passage 86 into a pair of vertically spaced slipways 96 and 98.

With reference to FIGS. 3 and 7 of the drawings, the plane identified by the reference numeral 100 is located at half the height of the corner blocks and the first clamping plane 102 extends through the slipway 48 of the anchoring block and the slipway 98 of the secondary corner block. The second clamping plane 104 extends through the slipway 46 of the anchoring corner block and the slipway 96 of the secondary corner block.

As shown in FIG. 1 of the drawings, the flexible cable 24 has one end secured to the eye-ring 54 of the eye-bolt 50 and extends through the passage 42 formed in the end wall 40 of the corner block and through the passages 84 and 86 formed in the secondary corner blocks and has its other end releasably secured in the V-shaped channel of the second clamping means.

As will be described hereinafter, the corner blocks constructed in accordance with the embodiment of the invention illustrated in FIGS. 3 to 7 of the drawings may serve to operably locate the tensioning cable at any one of four clamping planes.

Figure 9:
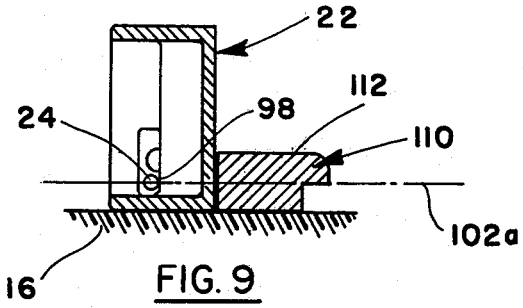
FIGS. 9, 10, 11 and 12 are sectional views through one arm of the secondary corner block of FIG. 6 showing the flexible cable located in four different planes for use in clamping frame mouldings of different heights.
Figure 10:
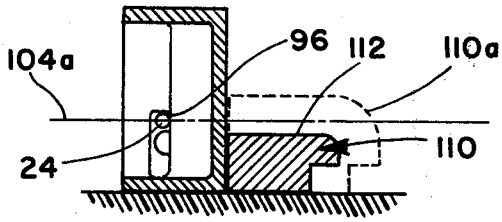

In FIGS. 9 and 10 of the drawings, the reference numeral 110 refers generally to a picture frame moulding which has a very low profile. So that the clamping apparatus of the present invention may be stable when a tensioning load is applied by means of the flexible cable, the cable 24 is located in the slipway 98 of the secondary corner blocks as shown in FIG. 9 of the drawings and extends through the slipway 48 of the anchoring corner block. Thus, the flexible cable extends in a tensioning plane 102 which is uniformly spaced above the support surface 16 at a level below the upper face 112 of the moulding.

As previously indicated, the tensioning cable 24 may be located in either one of the slipways 98 or 96. However, it is important to locate the tensioning cable in a tensioning plane which is spaced above the base 16 as far as possible without extending above the level of the upper face of the moulding and preferably in a plane which extends through a face of the moulding which abuts the inner face 72 of the corner block. FIG. 10 of the drawings illustrates an undesirable location of the flexible cable 24. With the flexible cable 24 located in the slipway 96 and extending in the plane 104 above the upper face 112 of the moulding, the corner block would tend to pivot about the edge of the moulding and would not provide a stable assembly.

It will, however, be noted that the location of the cable 24 in the plane 104*a* would be appropriate if the moulding was proportioned as shown in broken lines at 110*a*.

Figure 11:
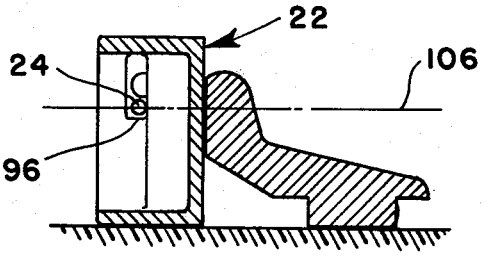
Figure 12:
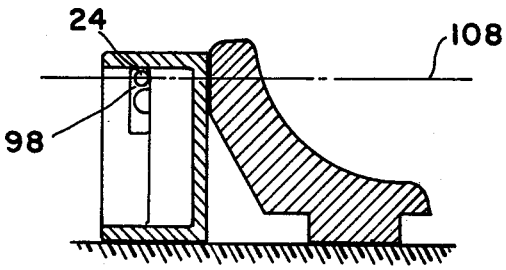

FIGS. 11 and 12 of the drawings show the secondary corner block 22 inverted from the position shown in FIGS. 9 and 10 so that by locating the cable 24 in the slipway 96, it will extend in a clamping plane 106. FIG. 12 shows the flexible cable 24 located in the slipway 98 and extending in a clamping plane 108.

From the foregoing it will be apparent that the corner blocks may serve to locate the tensioning cable in any one of four different tensioning planes. It will be understood that the corner blocks may readily be modified to include one or more additional slipways, with the total number of clamping planes increasing by a factor of two for each additional slipway provided.

Figure 13:
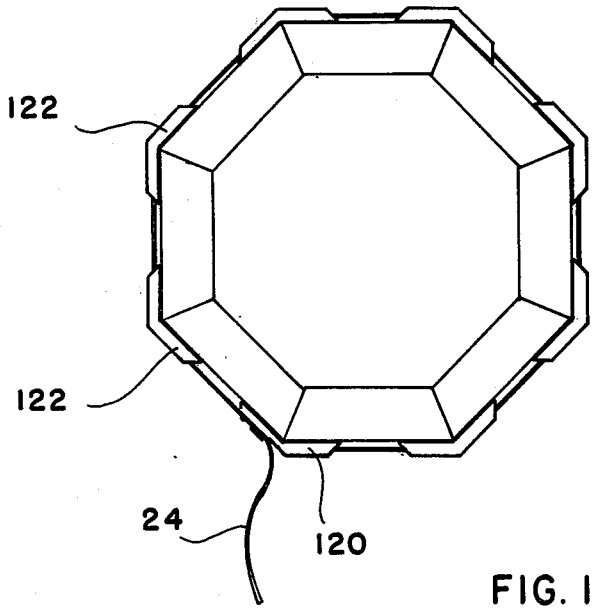
FIG. 13 is a plan view of a clamping apparatus constructed in accordance with an embodiment of the present invention for use in assembling an octagonal shaped picture frame.

As shown in FIG. 13 of the drawings, an anchoring corner block 120 and secondary corner blocks 122 may be formed so as to provide support for a frame having an octagonal configuration. It will be understood that the only difference between the secondary corner blocks and the anchoring corner blocks which is required in order to achieve this configuration is an adjustment in the included angle between the arms of the corner blocks.

Figure 14:
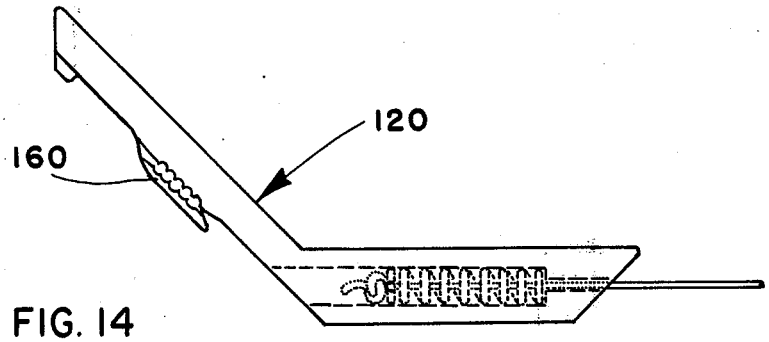
FIG. 14 is a plan view of a corner block constructed in accordance with a further embodiment of the present invention.
Figure 15:
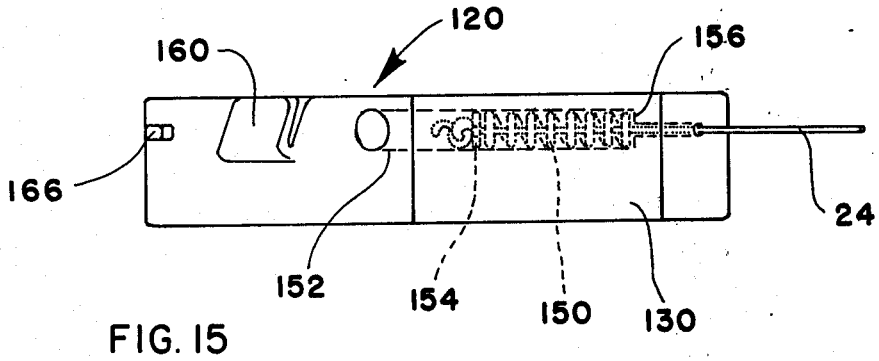
FIG. 15 is a front view of the corner block of FIG. 14.

The anchoring corner block 120, illustrated in FIGS. 14 and 15 of the drawings, has a quick release clamping device 160 and a guide finger 166 similar to that of the anchoring corner block 20. The eye-bolt 50 is, however, replaced by a coil spring 150 which is located in a passage 152 which extends through the arm 130 and has a shoulder 156 at one end thereof against which one end of the spring 150 bears. A washer 154 is secured at one end of the flexible cable 24 and bears against the other end of the compression spring 150. In use, the compression spring 150 will be at least partially compressed when a tensioning load is applied to the flexible cable and, as a result, if the cable should slip slightly or be drawn slightly out of the clamping jaws, the spring 150 will reassert itself to maintain tension in the flexible cable.

Figure 16:
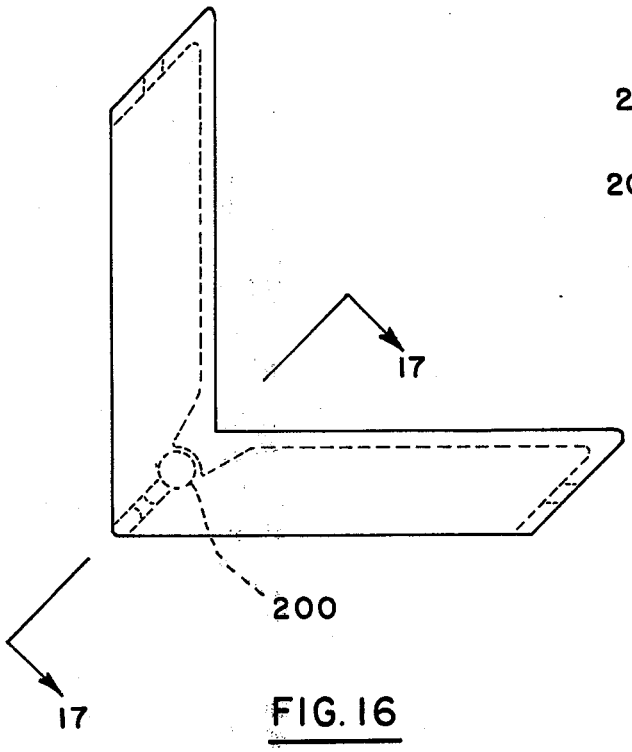
FIG. 16 is a plan view of a corner block constructed in accordance with a further embodiment of the present invention.
Figure 17:
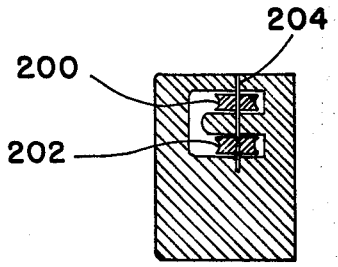
FIG. 17 is a sectional view along the line 17—17 of FIG. 16.

The corner block illustrated in FIGS. 16 and 17 of the drawings differs from that previously described in that guide pulleys 200 and 202 are mounted for rotation on support shaft 204. The guide pulleys 200 and 202 form the slipways about which the tensioning cable extends in use and further serve to reduce the resistance to movement of the cable along the slipways.

In use, a plurality of picture frame members are positioned in the required frame configuration on the support surface 16 and corner blocks are provided at each corner of the frame, one of the corner blocks being an anchoring corner block and the other corner blocks being secondary corner blocks. The flexible cable is extended from its first securing means on the anchoring corner block along the selected tensioning plane through the appropriate slipway in the end wall of the anchoring corner block and the end walls of the secondary corner blocks to be secured in the quick release clamping mechanism of the corner block. Tension may be applied to the cable by manually engaging the cable and pulling it and the tension may be retained in the cable by securing the cable in the quick release clamping means while it is subjected to the tensile load. Having applied the initial tension to the cable, an additional load may be applied to the cable by rotating the wingnut 56. This will further serve to ensure that a substantially uniform tensile load is applied to the cable along its full length.

A clamping apparatus constructed in accordance with one or other of the several embodiments of the present invention described above has several advantages over the structure previously proposed for use in the assembly of picture frames.

In the apparatus described in the preferred embodiments, a substantially uniform load can be applied by the assembly by reason of the fact that there is very little resistance to the movement of the flexible cable along the selected slipway. The resistance is minimized by the rounding of the corners about which the cable extends and in the embodiment illustrated in FIGS. 16 and 17 by the provision of pulleys. The uniform distribution of the clamping load about the frame is important as it serves to provide an equal closing force at all of the miter joints. Furthermore the application of the clamping force in the preselected plane serves to stabilize the frame in the required configuration so that it is not necessary to secure any of the corner blocks with respect to a base. Consequently, after the corner blocks have been mounted and secured by the tensioning cable as previously described, the picture frame with the corner blocks and the operably located cable may be removed from the work bench and stored in a convenient storage location until the adhesive which is located between the abutting ends of the frame member has set. Thus, it is possible for the framer to set up a number of frames using the same work bench.

The provision of the quick release clamping mechanism greatly increases the speed with which the corner blocks may be drawn together into clamping engagement with the frame and the speed with which they may be released.

A further substantial advantage to be derived from the preferred form of the apparatus is in the fact that the tensioning cable may remain in a position threaded through each of the secondary corner blocks so that when the apparatus is not in use and when it is being manipulated into the required configuration, the various corner blocks may remain connected to one another.

The provision of a plurality of slipways located at spaced intervals from one side of the central plane of the corner blocks and the corresponding location of the first and second securing mechanisms of the anchoring block permits the relatively thin anchoring cable to be located at any one of a plurality of heights above the support surface as it provides for adjustment of the height of the clamping plane. The thin flexible cable is superior to a wide band as it moves more freely over the slipway so that the tensioning load can be more uniformly distributed along the length thereof.

The use of a flexible cable such as a nylon rope or the like also permits the apparatus to be used in the construction of frames of wide ranging proportions without requiring any elaborate adjustment.

The apparatus of the present invention permits the compressive forces to be applied through each corner block substantially simultaneously and substantially uniformly. The load is not applied sequentially with the result that it is much simpler to obtain an even closing of each corner. When the load is applied sequentially to one corner after another in the previous devices, difficulty is frequently experienced in attempting to obtain an effective closure of the last corner, with the result that it is frequently necessary to reinforce the corners by nailing or the like. With the apparatus of the present invention, the corners may be brought together simultaneously and accurately and little or no uneven stresses develop.

Various structural modifications over and above those described in the present specification may be effected without departing from the scope of the present invention. For example, the corner blocks may be constructed so that the included angle between the arms of each block is angularly adjustable. This modification and other obvious modifications will be apparent to those skilled in the art.

The apparatus of the present invention is simple to operate with the result that it may be used effectively by individuals having a minimum of skill and experience in the assembly of picture frames. The apparatus is also inexpensive to manufacture.

What I claim as my invention is:

1. A clamping apparatus for use in assembling a picture frame comprising:

(a) an anchoring corner block having frame support surfaces adapted to engage adjacent ends of one pair of picture frame members of an assembled set of picture frame members arranged in the required frame configuration, (b) a flexible cable, (c) first securing means on said anchoring corner block for securing one end of said flexible cable with respect to said anchoring corner block and second securing means on said anchoring corner block for releasably securing a second end of said flexible cable, (d) said flexible cable having a sufficient length to extend from said first securing means about the external periphery of the assembled set of picture frame members to said second securing means, (e) a plurality of secondary corner blocks, each having; a frame support surface adapted to engage and support a pair of adjacent ends of the assembled set of picture frame members, cable guide means on each secondary corner block adapted to receive and guide said flexible cable therealong such that said flexible cable may be drawn tightly about said assembled set with the tensile load which is applied to the cable in use substantially uniformly distributed along the length of the flexible cable from said first securing means to said second securing means of said anchoring corner block, (f) said anchoring corner block and said secondary corner blocks each having a pair of oppositely disposed mounting faces extending in parallel planes which are uniformly spaced from a central plane located at half the height to each block such that either of said mounting faces may be located in a datum plane during assembly of a picture frame, (g) said guide means of each secondary corner block including a set of two guide slipways, the slipways of each set being vertically spaced with respect to one another and each set of slipways being uniformly vertically offset with respect to said central plane to provide support for said flexible cable in either one of two planes disposed on either side of said central plane whereby said flexible cable may be supported in any one of four clamping planes disposed at different heights above said datum plane.

2. A clamping apparatus as claimed in claim 1 wherein said first and second securing means of said anchoring corner block are uniformly vertically offset with respect to said central plane and a slipway guide is located outwardly from said first and second securing means for deflecting said flexible cable into either one of said two planes.

3. A clamping apparatus as claimed in claim 1 wherein each secondary corner block is formed with a transfer passage extending between said two guide slipways whereby said cable may be transferred from one slipway to the other as required in use, said transfer passage being proportioned to be smaller than the diameter of the flexible cable whereby the flexible cable must be forcibly directed through said transfer passage to be deliberately located in one or other of said slipways.

4. A clamping apparatus for retaining an assembled set of picture frame members in the required frame configuration comprising:

(a) a flexible cable, (b) a plurality of corner blocks each comprising a pair of arms connected to one another at their inner ends to form a generally L-shaped body, each arm having a pair of oppositely disposed side faces upon which it may rest in use, an inwardly directed frame support surface extending between said side faces, an outwardly directed face, and a free end remote from the inner ends thereof, (c) one of said corner blocks being an anchoring corner block having first securing means supported by a first of said arms of said body for securing one end of said flexible cable with respect to said anchoring corner block and second securing means in the form of a quick release cleat on the second arm of said body for releasably securing a second end of said flexible cable, (d) the remainder of said corner blocks being secondary corner blocks, each secondary corner block including a corner post located on said outwardly directed face at the intersection of said arms, said corner post being formed with an arcuate guide face about which said flexible cable bends as it is extended around said secondary corner blocks arranged in the required frame configuration, said secondary corner blocks also having an end wall projecting outwardly from said outwardly directed face at the free end of each arm and at said corner post, guide passage means opening through each of said end walls in the plane of said arcuate guide face of said corner post, said flexible cable being threaded through said passages to be retained by said secondary corner blocks, (e) said flexible cable having a sufficient length to extend from said first securing means about the external periphery of the assembled corner blocks from said first securing means to said second securing means of said anchoring corner block.

5. A clamping apparatus for use in assembling a picture frame comprising:

(a) an anchoring corner block having frame support surfaces adapted to engage adjacent ends of one pair of picture frame members of an assembled set of picture frame members arranged in the required frame configuration, (b) a flexible cable, (c) first securing means on said anchoring corner block for securing one end of said flexible cable with respect to said anchoring corner block and second securing means on said anchoring corner block for releasably securing a second end of said flexible cable, (d) said flexible cable having a sufficient length to extend from said first securing means about the external periphery of the assembled set of picture frame members to said second securing means, (e) a plurality of secondary corner blocks, each having; a frame support surface adapted to engage and support a pair of adjacent ends of the assembled set of picture frame members, cable guide means on each secondary corner block adapted to receive and guide said flexible cable therealong such that said flexible cable may be drawn tightly about said assembled set with the tensile load which is applied to the cable in use substantially uniformly distributed along the length of the flexible cable from said first securing means to said second securing means of said anchoring corner block, (f) said anchoring corner block comprising a substantially L-shaped bracket having first and second arms which are inclined to one another, each arm having an inner face forming one of said frame support surfaces and an outer face, said first securing means being located on a first of said arms and said second securing means being located on a second of said arms, (g) said second securing means being in the form of a quick release cleat which opens longitudinally of said second arm.

6. A clamping apparatus for use in assembling a picture frame comprising:

(a) an anchoring corner block having frame support surfaces adapted to engage adjacent ends of one pair of picture frame members of an assembled set of picture frame members arranged in the required frame configuration, (b) a flexible cable, (c) first securing means on said anchoring corner block for securing one end of said flexible cable with respect to said anchoring corner block and second securing means on said anchoring corner block for releasably securing a second end of said flexible cable, (d) said flexible cable having a sufficient length to extend from said first securing means about the external periphery of the assembled set of picture frame members to said second securing means, (e) a plurality of secondary corner blocks, each having; a frame support surface adapted to engage and support a pair of adjacent ends of the assembled set of picture frame members, cable guide means on each secondary corner block adapted to receive and guide said flexible cable therealong such that said flexible cable may be drawn tightly about said assembled set with the tensile load which is applied to the cable in use substantially uniformly distributed along the length of the flexible cable from said first securing means to said second securing means of said anchoring corner block, (f) said anchoring corner block comprising a substantially L-shaped bracket having first and second arms which are inclined to one another, each arm having an inner face forming one of said frame support surfaces and an outer face, said first securing means being located on a first of said arms and said second securing means being located on a second of said arms, (g) said first securing means including a resilient anchoring means for applying a tensile load to the end of the flexible cable which is secured thereto so as to maintain the application of a tensile load to the flexible cable in use and to prevent the release of the clamping apparatus resulting from a loss of tensile load in use.

7. A clamping apparatus for use in assembling a picture frame comprising;

(a) a flexible cable, (b) a plurality of corner blocks, each having;

(i) first and second oppositely disposed support surfaces which are equally spaced from one another and on which the block may rest in an operative position in use, (ii) a frame gripping notch arranged to receive and grip ends of a pair of picture frame members of an assembled set of picture frame members, said notch opening through said first and second support surfaces whereby the abutting relationship of the abutting ends of the picture frame members may be viewed at either said first or second oppositely disposed surface, (iii) cable guide means on each corner block adapted to receive and guide said flexible cable in a first clamping plane extending parallel to said first and second support surfaces, said cable guide means being arranged to dispose said first clamping plane more closely adjacent said first support surface than said second support surface whereby the height of said first clamping plane above a support structure may be varied by selectively positioning said first or second support surfaces on the supporting structure, (c) means on at least one of said corner blocks for securing said flexible cable in a position extending in said first clamping plane to apply a clamping force to said corner blocks urging said corner blocks toward one another.

8. A clamping apparatus as claimed in claim 7 wherein said means for securing said flexible cable includes a quick release cleat located on an outer face of said block, said quick release cleat having a cable clamping passage extending in said clamping plane.

9. A clamping apparatus as claimed in claim 7 wherein said means for securing said flexible cable includes a resilient anchoring means for applying a tensile load to the end of the flexible cable which is secured thereto so as to maintain the application of a tensile load to the flexible cable in use and to prevent the release of the clamping apparatus resulting from a loss of tensile load in use.

10. A clamping apparatus as claimed in claim 8 wherein said means for securing said flexible cable includes a resilient anchoring means for applying a tensile load to the end of the flexible cable which is secured thereto so as to maintain the application of a tensile load to the flexible cable in use and to prevent the release of the clamping apparatus resulting from a loss of tensile load in use.

11. A clamping apparatus as claimed in claim 7 wherein said means for securing said flexible cable includes an eye-bolt having a head at one end thereof formed with an eye opening and an elongated threaded body, the body being mounted for longitudinal movement in a direction parallel to the clamping plane in a passage formed in an end wall of its associated corner block, a nut threadably mounted on said threaded body for movement relative thereto to move the eye-bolt along the clamping plane, said head of said eye-bolt projecting laterally from said elongated body and being disposed sufficiently close to an adjacent wall of its associated corner block to engage said wall and prevent rotation of the eye-bolt when said nut is rotated to drive said eye-bolt along said clamping plane to tighten and release said flexible cable in use.

* * * * *